United States Patent [19]

Milward

[11] Patent Number: 4,779,541

[45] Date of Patent: Oct. 25, 1988

[54] STACKED TABLE SET

[76] Inventor: David B. Milward, 350 S. Ocean Blvd., Apt. 16, Boca Raton, Fla. 33432

[21] Appl. No.: 27,516

[22] Filed: Mar. 18, 1987

[51] Int. Cl.[4] ..... A47B 7/00

[52] U.S. Cl. ..... 108/91; 108/53.1

[58] Field of Search ..... 108/91, 92, 93, 53.1, 108/53.3, 53.5; 211/194; 297/239

[56] References Cited

U.S. PATENT DOCUMENTS

| | | | |
|---|---|---|---|
| D. 143,454 | 1/1946 | White | 108/91 X |
| D. 153,909 | 5/1949 | Wais | 108/91 X |
| D. 210,735 | 4/1968 | Magistretti | 108/91 X |
| 1,856,935 | 5/1932 | Turner | 108/91 X |
| 1,895,323 | 1/1933 | Hauf | 108/91 |
| 1,989,426 | 1/1935 | Pollak . | |
| 2,409,027 | 10/1946 | Fergusson | 108/91 |
| 2,833,607 | 5/1958 | Mackintosh | 108/91 X |
| 2,871,073 | 1/1959 | Swanson . | |
| 3,100,459 | 8/1963 | Liss et al. | 108/91 |
| 3,180,288 | 4/1965 | McCowan | 108/53.5 X |
| 3,326,148 | 1/1967 | Jakobsen | 108/91 |
| 3,347,186 | 10/1967 | Khattar . | |
| 3,430,588 | 3/1969 | Heyer | 108/91 |

FOREIGN PATENT DOCUMENTS

| | | | |
|---|---|---|---|
| 802271 | 2/1951 | Fed. Rep. of Germany | 108/91 |
| 2140144 | 2/1973 | Fed. Rep. of Germany | 108/91 |
| 2208441 | 8/1973 | Fed. Rep. of Germany | 108/91 |
| 2523079 | 9/1983 | France | 108/53.3 |
| 649622 | 2/1979 | U.S.S.R. | 108/53.1 |
| 462419 | 3/1937 | United Kingdom . | |

*Primary Examiner*—Kenneth J. Dorner
*Assistant Examiner*—José V. Chen
*Attorney, Agent, or Firm*—Christel, Bean & Linihan

[57] ABSTRACT

A set of tables which may be stacked in any order of stacking, one directly over another. The set of tables includes a first table having a polygonal table top and at least three downwardly extending legs, the inner sides of the upper ends of the legs being joined at spaced apart locations on the sides of the table top, and the legs, throughout their length being disposed entirely outside of the perimeter of the table top. The additional tables of the set each include a polygonal table top of substantially the same dimensions as the polygonal table top of the first table, and at least three downwardly extending legs, which are joined to spaced apart locations on the sides of the associated table top. The locations on the sides of the additional table tops to which the legs are joined are laterally offset with respect to each other and to the locations on the first table top so that the first and additional tables may be stacked one directly on top of the other with the legs extending in a downwardly direction without the legs of one table contacting the legs of the other table.

9 Claims, 1 Drawing Sheet

STACKED TABLE SET

TECHNICAL FIELD

The present invention relates generally to a set of tables which may be stacked one upon another, and more particularly to a set of stackable tables which may be stacked directly one upon another in any order and also in any orientation so long as the tops of the tables are in edge to edge vertical alignment.

BACKGROUND OF THE INVENTION

Tables which can be stacked, one on top of the other, are well known in the art and typical examples are shown in U.S. Pat. No. 2,871,073 to Swanson; U.S. Pat No. 3,326,148 to Jakobsen; and U.S. Pat No. 3,347,186 to Khattar and also in U.S. Pat. No. Des. 153,904 to Wais. Jakobsen and Swanson each disclose a plurality of identical tables which may be stacked in any order, however, when these tables are stacked, the tables on top are offset with respect to those tables below. Khattar discloses a set of only two tables or the like which may be stacked, but in order to stack the tables it is necessary to invert one of the tables prior to stacking. While Wais discloses tables which can be stacked one directly on top of the other, his tables must be stacked in a specific order.

OBJECTS AND SUMMARY OF THE INVENTION

It is an object of the present invention to provide a novel set of stackable tables wherein each table may be compactly stacked directly upon another table.

More specifically, it is an object of the present invention to provide a novel set of stackable tables wherein the tables can be stacked directly one upon another and in any order.

It is another object of the present invention to provide a set of stackable tables which may be compactly stacked in any order and in any orientation provided only that the edges of the tops of the tables are in vertical alignment with each other.

The above objects as well as other objects of this invention are accomplished by providing two or more tables having polygonal tables tops, such as rectangular surfaces, and each table having downwardly extending legs, the tops of the legs being joined to the sides of the table top. The tops of the legs of the first table are joined to first spaced apart locations on the sides of the associated table top, and the legs on each of the second and subsequent tables are joined to other spaced apart locations on the sides of their associated table tops the locations to which the legs are joined on the second and subsequent tables being laterally offset from the locations on the first table as well as from each other so that when the tables are stacked one on top of another, the legs of one table will not contact the legs of any other table.

The above objects and other objects and advantages of this invention will become more apparent after a consideration of the following detailed description taken in conjunction with the accompanying drawings in which a preferred form of this invention is illustrated.

DETAILED DESCRIPTION

Figure 1:
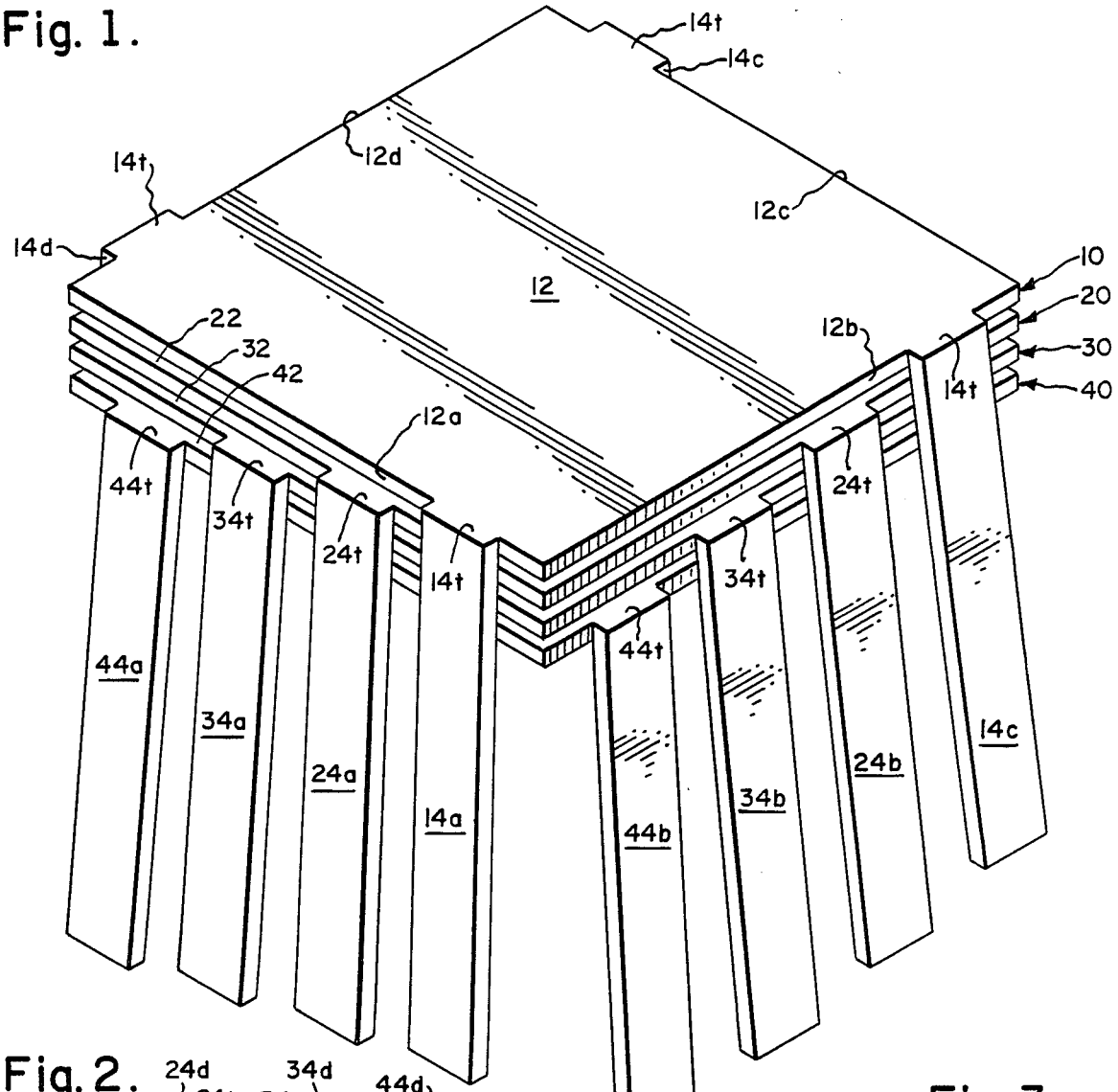
FIG. 1 illustrates a set of four separate tables made in accordances with the principles of this invention, which tables have been stacked directly one upon another.

The set of stackable tables shown in FIG. 1 includes four tables which are indicated generally at 10, 20, 30, and 40. Each of the tables has a table top which in the illustrated embodiment is square, and each table additionally has four legs, the top end of each of the four legs being secured to one side of the table top. Thus, the table 10 has a table top 12 and four legs 14*a*, 14*b*, 14*c*, and 14*d*. Similarly table 20 has a table top 22 and four legs 24*a*–24*d*. Tables 30 and 40 also have tops 32 and 42 and legs 34*a*–34*d* and 44*a*–44*d*, respectively.

The tops of all the tables are substantially identical. Therefore, the tables can be stacked directly on top of one another with the sides of the table tops in vertical alignment.

Corner spacers 16, 26, 36, 46 are secured to the under surface of each of the table tops 12, 22, 32, and 42, respectively, in order to prevent the bottom surface of one table top from contacting the top surface of that table immediately below it when stacked, the spacers being made of a suitable material which will not mar the top surface of the table immediately below it.

The legs of all of the tables are also all essentially identical, and the only substantial difference between the tables in a set is the locations where the legs are secured to the top. Thus, the legs are preferably rectangular in cross section and of the same length. Each leg is joined to an associated side of the table top. Thus, leg 14*a* is joined to side 12*a*, leg 14*b* is joined to side 12*b*, and so on. In addition, the top surface 14*t*, 24*t*, 34*t* or 44*t* of each leg lies in the plane of the top surface of the associated table top. It should be noted that the widest surface of the rectangular legs is joined to the sides of the top and, as can best be seen from FIG. 3, the inner surface of each leg preferably extends at an angle slightly in excess of 90° away from the bottom surface of the top to facilitate the stacking of the tables. Also, as can best be seen from FIG. 2 all of the legs throughout their length, are disposed entirely outside the perimeter of each table top.

The only substantial difference between the tables 10, 20, 30, and 40 is in the location to which the legs are joined to the sides. Thus, each leg for each side of each table top is offset in the same direction and the same distance from the center of the side, indicated by broken lines 18 in FIG. 2, the offset and the direction of the offset differing from one table to another. Thus, as can best be seen from FIG. 2, leg 14*d* is offset from the center line 18 in a counterclockwise direction, by a distance $D_1$. Similarly, legs 14*a*, *b* and *c* are also offset a distance $D_1$ from the center line 18 in a counterclockwise direction to an amount also equal to $D_1$. Legs 24*a*–*d* are offset from the center line 18 by an amount $D_2$, also in a counterclockwise direction. The distance $D_1$ is greater than the sum of the width of a table leg and the distance $D_2$. Legs 34*a*–*d* are offset in a clockwise direction from the center line 18 at a distance $D_3$, and finally legs 44*a*–*d* are offset a distance $D_4$, also in a clockwise direction, from the center lines 18, $D_4$ being a distance greater than the width of a leg plus the distance $D_3$. By using these various offsets the tables can be stacked directly on top of one another in any order, provided only that the tables all come from a single set of stacking tables.

Figure 2:
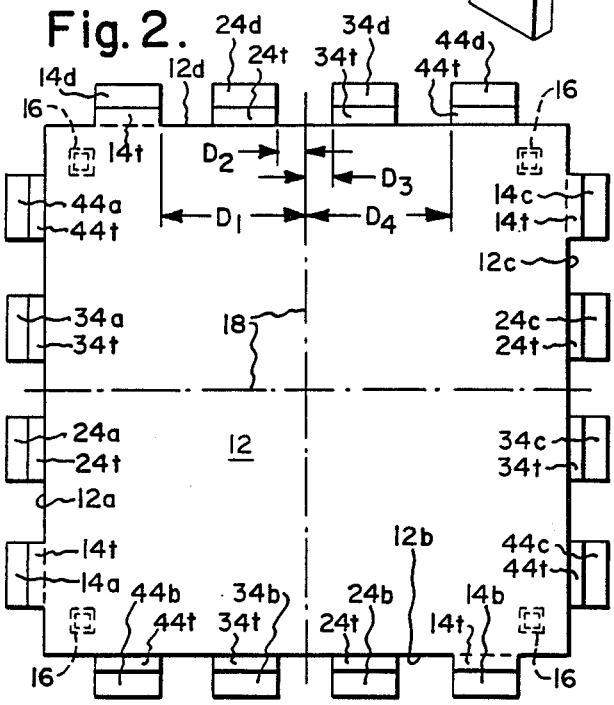
FIG. 2 is a top view of the set of stackable tables shown in FIG. 1.
Figure 3:
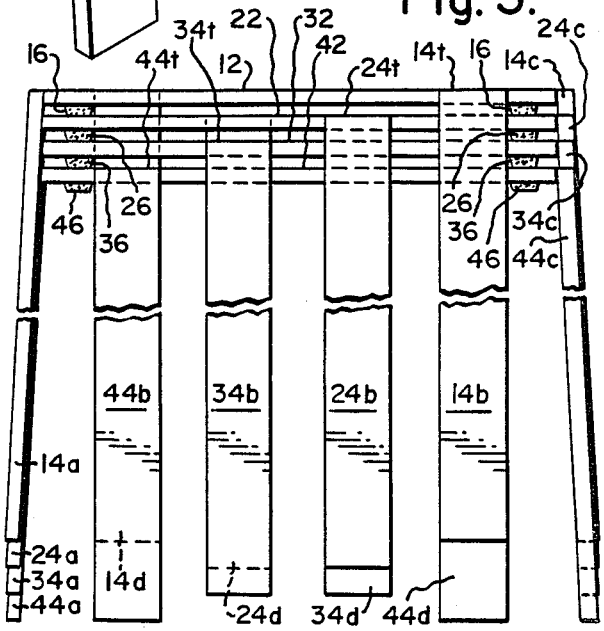
FIG. 3 is a side view of the set of stackable tables shown in FIG. 1.

While the offsets shown in FIG. 2 are from the center line, it can also be appreciated that the offset could be measured from a corner. Thus, legs 14 could be offset a first distance from the counterclockwise coner, legs 24 could be offset a second distance from the counterclockwise corner, the second distance being equal to the distance of the first offset plus the width of the leg plus a small amount to give proper clearance between the legs. The offsets for the other legs would be established in the same manner. Thus, in a set of tables which can be stacked one directly over another, the second table of the set must have legs joined on the sides of the second table top and which are offset sufficiently with respect to the locations and the sides of the first table top to which the first legs are joined so that the first and second tables may be stacked with the legs extending in a downward direction without the legs of one table contacting the legs of the other. The third table would have the same relationship, and thus the third table's legs must be offset with respect to the first and second tables in such a manner that they also will not contact when stacked with the legs extending in a downwardly direction. This would be true for fourth and subsequent tables.

While the table tops and legs can be made from separate elements and suitably joined together, however, they are preferably of a one piece molded construction.

Although, the invention has been illustrated in the figures as a set of four stackable tables having square tops, obviously many variations would occur. Thus, a set of tables could be of a number other than four. Also, the tables could have rectangular tops rather than square tops. In addition, the table top surfaces could be of other polygonal configurations, such as for example, hexagons, triangles, etc. Whatever the shape of the tabletop, though, the same principles set forth would apply, it only being necessary that table tops be substantially identical and that the legs of one table top be offset with respect to the legs of all of the other tables so that when stacked one leg would not interefere with the leg of any other table. When the tops of the tables all have equal sides, the distances $D_1$, $D_2$, $D_3$ and $D_4$ will generally all be the same for each of the sides of a table. However, if the sides were of unequal lengths, as for example in rectangular tops other than squares, the distances may vary from side to side. For example the distance $D_1$ for the longer side of a rectangle may be greater (when measured from the centerline) than the distance $D_1$ for a shorter side. The actual placement of the legs may also vary for aesthetic and stability reasons, it only being necessary that the legs of each table be laterally offset from the legs of all other tables of a set so they do not interfere with one another when stacked. While the preferred structure in which the principles of the present invention have been incorporated is shown and described above, it is to be understood that this invention is not to be limited to the particular details shown and described above, but that, in fact, widely differing means may be employed in the practice of the broader aspects of this invention.

What is claimed is:

1. A set of tables which may be stacked in any order of stacking one directly over another and including:

a first table having a horizontally disposed table top of a regular polygonal configuration and having sides of equal length and top and bottom surfaces, and a plurality of downwardly extending legs equal in number to the number of sides of the table top, each leg being of the same length and having upper and lower ends and inner and outer sides each side of the table top having the inner side of the upper end of one of the legs joined thereto, each leg being offset from a corner of the associate side the same direction and distance, said legs throughout their length being disposed entirely outside the perimeter of the table top; and a second table having a horizontal disposed regular polygonal table top of substantially the same dimensions as the regular polygonal table top of the first table, the second table top having sides of equal length and top and bottom surfaces, and a plurality of downwardly extending legs equal in number to the number of sides of the table top, each leg being of the same length and having upper and lower ends and inner and outer sides, each side of the table top having the inner side of the upper end of one of the legs joined thereto, each leg being offset from a corner of the associated side in the same direction and distance, which distance is greater than the distance the legs of the first table are offset by an amount at least equal to or greater than the first distance plus the width of the legs, said legs throughout their length being disposed entirely outside the perimeter of the table top, so that the first and second tables may be stacked one directly on top of the other with the legs extending in a downward direction without the legs of one table contacting the legs of the other table.

2. A set of tables as set forth in claim 1 further characterized by the provision of:

a third table having a horizontally disposed regular polygonal table top of substantially the same dimensions as the regular polygonal table top of the first table, the third table top having sides of equal length and top and bottom surfaces, and a plurality of downwardly extending legs equal in number to the number of sides of the table top, each leg being of the same length and having upper and lower ends and inner and outer sides, each side of the table top of the third table having the inner side of the upper end of one of the legs joined thereto, each leg being offset from a corner of the associated side in the same direction and distance, which distance is greater than the distance the legs of the second table are offset by an amount at least equal to or greater than the distance the second legs are offset from a corner of their associated sides plus the width of the legs, said legs throughout their length being disposed entirely outside of the perimeter of the table top, so that the first, second and third tables may be stacked one directly on top of the other with the legs extending in a downward direction without the legs of one table contacting the legs of any other table.

3. A set of tables as set forth in claim 1 further characterized by the provision of:

additional tables each having a horizontally disposed regular polygonal table top of substantially the same dimensions as the regular polygonal table top of the first table, each additional table top having sides of equal length and top and bottom surfaces, and a plurality of downwardly extending legs for each table, each having upper and lower ends and inner and outer sides, the inner sides of the upper ends of the legs of each additional table being joined to spaced apart locations on the sides of the table top, said legs throughout their length being disposed entirely outside the perimeter of the table top;

the locations on the sides of the additional table tops being offset with respect to each other and to the locations on the first and second table tops so that the first, second and additional tables may be stacked one directly on top of the other with the legs extending in a downwardly direction without the legs of one table contacting the legs of the other table.

4. The set of tables as set forth in claim 1 wherein each of the legs are rectangular in cross section.

5. The set of tables as set forth in claim 4 wherein the inner side of each leg of each table is wider than an adjacent side.

6. The set of tables as set forth in claim 4 wherein the top of each leg of each table is flush with the top of the table top.

7. The set of tables as set forth in claim 1 wherein each table top is square, there being one leg of each table joined to each side of each table top, and wherein each leg of each table is offset in the same direction and the same spaced relationship to the center of the side to which it is joined whereby the tables can be stacked one upon the other regardless of orientation.

8. The set of tables as set forth in claim 1 wherein each table is of a molded construction.

9. A set of tables which may be stacked in any order of stacking one directly over another and including:

a first table having a horizontally disposed square table top having sides and top and bottom surfaces, and four downwardly extending legs, each having upper and lower ends and inner and outer sides, each side of the table top having the inner side of the upper end of one of the legs joined thereto, each leg being offset from a corner in the same direction and distance, said legs throughout their length being disposed entirely outside the perimeter of the table top; and a second table having a horizontally disposed square table top of substantially the same dimensions as the polygonal table top of the first table, the second table top having sides and top and bottom surfaces, and four downwardly extending legs each having upper and lower ends and inner and outer sides, each side of the table top having the inner side of the upper end of one of the legs joined thereto, each leg being offset from a corner of the associated side in the same direction and distance, which distance is greater than the distance the legs of the first table are offset by an amount at least equal to or greater than the first distance plus the width of the legs, said legs throughout their length being disposed entirely outside the perimeter of the table top, the parts being so arranged and constructed so that the first and second tables may be stacked one directly on top of the other with the legs extending in a downward direction without the legs of one table contacting the legs of the other table.

* * * * *